United States Patent [19]

de Sanz

[11] 3,983,658

[45] Oct. 5, 1976

[54] PINATAS

[76] Inventor: Enrique Sort de Sanz, 621 Fig Ave., Chulavista, Calif. 92010

[22] Filed: Dec. 24, 1975

[21] Appl. No.: 644,003

Related U.S. Application Data

[63] Continuation-in-part of Ser. No. 558,512, March 14, 1975, abandoned.

[52] U.S. Cl. ..... 46/11; 46/38; 220/4 E; 206/315 R; 273/58 C; 273/DIG. 2; 428/11; 272/1 R

[51] Int. Cl.[2] ..... A63H 35/00

[58] Field of Search ..... 272/1 R; 46/38, 1 R, 46/11, 116, 88; 220/4 E, 4 B; 229/8; 206/315; 428/11, 8, 7, 35; 264/DIG. 77; 426/104, 123, 803; 273/58 B, 58 C, DIG. 8, DIG. 2

[56] References Cited

UNITED STATES PATENTS

| | | | |
|---|---|---|---|
| 1,423,122 | 7/1922 | Kyriazopoulos | 46/38 |
| 1,760,657 | 5/1930 | Monge | 46/38 |
| 1,856,634 | 5/1932 | Hartig | 426/123 X |
| 2,504,650 | 4/1950 | Chessrown | 273/58 B X |
| 2,784,512 | 3/1957 | Goodwin | 220/4 B X |
| 2,975,547 | 3/1961 | Greve | 273/58 B X |
| 2,986,300 | 5/1961 | Parrish | 220/4 E |
| 3,092,277 | 6/1963 | Brim | 220/4 E X |
| 3,346,137 | 10/1967 | Ricci | 220/4 E X |
| 3,520,078 | 7/1970 | Klamer | 46/11 X |
| 3,596,695 | 8/1971 | Stevenazzi | 220/4 E X |

FOREIGN PATENTS OR APPLICATIONS

| | | | |
|---|---|---|---|
| 34,040 | 8/1908 | Austria | 273/58 C |
| 814,211 | 9/1951 | Germany | 428/11 |
| 159,187 | 12/1932 | Switzerland | 46/1 R |
| 22,078 | 1/1908 | United Kingdom | 206/315 |

OTHER PUBLICATIONS

Taylor–Almark Products, Inc., "Pinata Handicraft Kit".

*Primary Examiner*—Richard C. Pinkham
*Assistant Examiner*—Arnold W. Kramer
*Attorney, Agent, or Firm*—Ladas, Parry, Von Gehr, Goldsmith & Deschamps

[57] ABSTRACT

The present invention is related to articles for amusement and more particularly to an improved pinata composed essentially of a hollow spherical body made of two equal halves which are joined. The hollow body is manufactured in two equal halves from expanded polystyrene which is light, strong, and frangible. The improved pinata is adorned on the outside with a plurality of strips and cuttings of paper of various colors and with prefabricated adornments of a flexible laminar material such as paper, cardboard or plastic to present the outer shape of any figure of fantasy. The pinata is provided with means for hanging such as cord, wire, or the like, and is filled with fruit, candies or petty gifts. When struck with a stick or club it breaks and allows its contents to fall to the floor where they can be grabbed and tussled for by the guests of a party or group.

4 Claims, 4 Drawing Figures

PINATAS

RELATED APPLICATIONS

This is a continuation-in-part application of an earlier filed copending application of Enrique Sort De Sanz, Ser. No. 558,512, filed Mar. 14, 1975, now abandoned, for Pinatas.

BACKGROUND OF THE INVENTION

1. Field of the Invention

Pinatas are articles of amusement which are used particularly in children's parties and gatherings, and consist generally of an earthenware vessel which is filled inside with fruits, candies and favors, the outside of which is adorned to make up a figure of fantasy such as a cartoon version of any kind of character such as an automaton like Mickey Mouse, Donald Duck, Peter Pan, a star, fruit, or a flower.

In traditional parties the pinatas are used as a part of the fun, filling them as above indicated and hanging them from some high place by means of a cord, wire or other hanging means and manually making them rise, descend or move at will in any direction to elude the blows from a stick or club wielded by one of the participants in the party. The object of the game is to break the pinata and cause its contents to fall on the floor where they can be fought over by the gathering, the most talented of whom will get the pick of the fruit, candy or petty gifts.

2. Description of the Prior Art

The conventional article or pinata hitherto known is a handcraft article composed of an earthenware pot such as a clay pot, which by its nature is voluminous, heavy, hard to transport and store; all of which makes it hard to produce in large quantities or in volume. Consequently, the article affords little profit considered as an industrial article or for large scale production, and hence there are many obstacles to its commercialization.

The foregoing drawbacks have led to a careful investigation of the inherent problems and to the effort to solve them in the most practical fashion possible to permit producing an article which is light, strong, breakable when struck, easy to produce, to transport and to store. The present invention affords a definitive solution to the problems hitherto involved in the manufacture and commercial distribution of pinatas.

SUMMARY OF THE INVENTION

One of the objects of the present invention is to provide an improved article for amusement and particularly improvements to a pinata which has better properties and characteristics than those known to date.

Another object is to provide an improved pinata consisting essentially of a spherical hollow body, made up to two equal and symmetrical halves which when joined together produce the body of the pinata.

Still another object of the invention resides in an improvement in pinatas structured as set forth above, of a hollow body made up in each of its halves by a light, strong material which is easily stored and transported without great difficulty and at a substantially reduced cost. These characteristics are fully met if a material such as expanded polystyrene foam is used.

Now in greater detail, the improved pinata of the present invention is composed of a hollow body made up of two symmetrical halves which are connected by sticking their flat portions one to the other with an adhesive which is suitable for the material being used. The hollow body is therefore simply a sphere dressed on the outside by pre-fabricated adornments for the purpose of giving the outer appearance of an attractive shape, as already stated, of a conventional article or of a character, either known or of fantasy. The outer surface both of the hollow body and of the adornments is covered with strips and cuttings of multicolored paper for the purpose of making the outside of the pinata more attractive.

The provision for hanging the pinata should be adequately secured to said hollow body so that when the pinata is suspended it will bear its weight including the inside load, without danger that the filled pinata will fall because of its own weight. For this purpose, the string or wire with which the pinata will be suspended passes through a lengthwise groove extending around the outside of the pinata, this groove traverses the two halves which make up the hollow body around the middle portion of each half, that is, transverse the face along which the two halves are brought together. The pinata presents at its upper end a hollow neck, around which the necessary ties can be made to hang which may be manipulated by the person who moves the pinata while another person is trying to hit it.

DETAILED DESCRIPTION OF THE INVENTION

Figure 1:
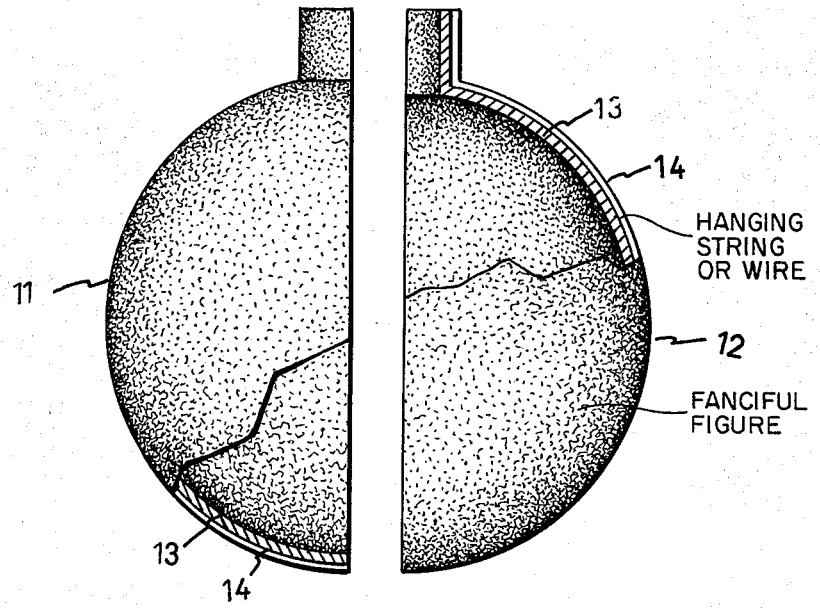
FIG. 1 is a schematic cross-sectional view of a pinata made in accordance with this invention.

With reference to the accompanying drawings, the improved pinata of the present patent specification as depicted in FIG. 1 shows halves 11 and 12, which when joined form the hollow body above specified. Hanging means 13 which may be manufactured from a flexible cord, wire, or the like serves to support the pinata which is covered by cover 14 made of cuttings of paper or the like.

Figure 2:
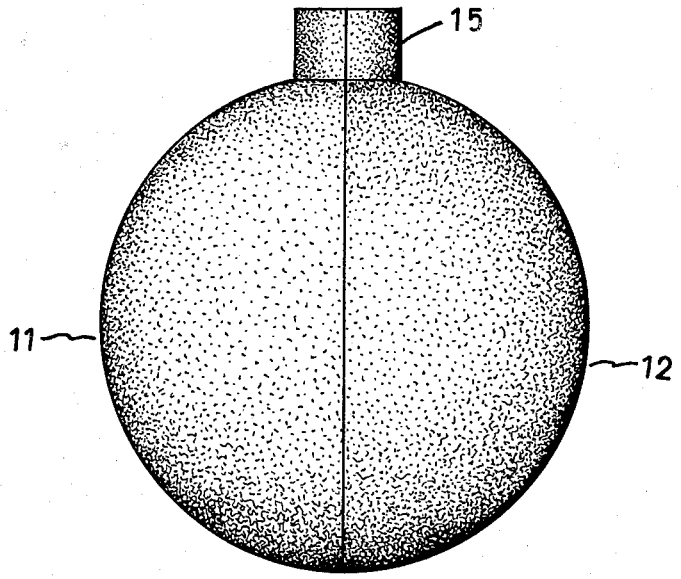
FIG. 2 is a side elevational view of the pinata.

In FIG. 2 is depicted a view of the outside of the pinata showing the two hollow halves when joined together. This same figure shows neck 15 integrated when joining together the hollow body.

Figure 3:
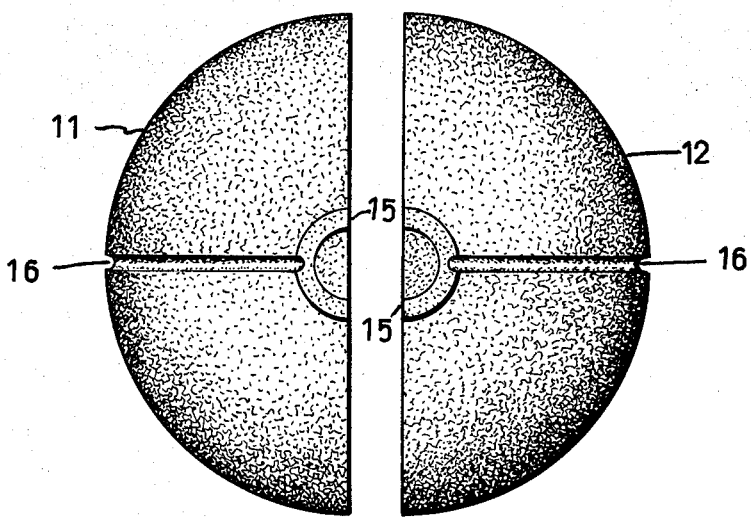
FIG. 3 is a top plan view of the two halves before being joined.

As may be easily seen in FIG. 3, the two hollow semi-spherical halves 11 and 12 have a lengthwise groove 16 extending all around the outside of each of members 11 and 12. The hanging means 13 are located in said groove, and may be tied therein.

Figure 4:
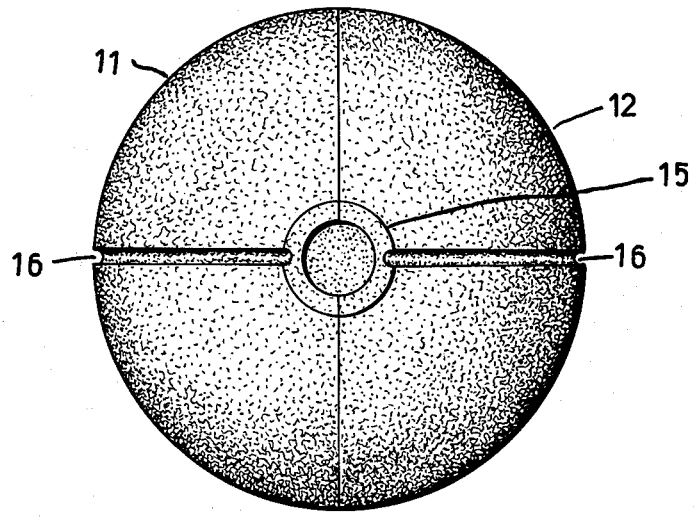
FIG. 4 is a top plan view of the pinata.

FIG. 4 shows the two halves of the pinata when joined together, showing the same structural parts above mentioned.

The halves 11 and 12 may be manufactured from expanded polystyrene foam or a suitable plastic or the like. A mold may be used (not shown) which has the shape of one of the halves of the hollow body which makes up the pinata. A material such as polystyrene may be extruded under pressure as it is injected into the mold. The hollow body is then taken out of the mold and joined to another like piece, since they are symmetrical, thus making up a spherical hollow body. To affix the two sides together an adequate conventional adhesive is used.

The mold in which the expanded material is formed has in its center portion a convex rib running longitudinally around such middle part. This rib will produce a groove 16 in the middle of the pinata similarly extending longitudinally around the outside of the hollow half; and this groove 16 is where the means 13 for hanging the pinata is inserted.

Once the pinata has been assembled by joining the two hollow halves, the next step is to adorn it with strips and cuttings of multicolored paper and/or with external decoration which completes the outer appearance of the pinata. Thus far the improved pinata which is the object of the present patent specification has been described in its preferred embodiment, in which the pinata is composed of two symmetrical halves which can be joined to form a hollow body whose external appearance is precisely the outside shape of the two halves joined. However, additionally various adornments adhering to the outside of the hollow body can be utilized as needed, to provide a given fanciful figure or to complete the caricature version of a fantasy character. These adornments can be complements of the dress of the figure or character, which complementary material in some cases cannot be properly premolded.

For example, to make up a starlike figure, the adornments consist of various hollow light cones. To make up a flower or fruit, the adornments consist of pre-fabricated petals or leaves. To make up a fanciful character, the adornments are additional external ornaments of the character, for example a belt, a cap or attachments thereto, a cigar or cigarette, a bow for the hair, and many other highly varied applications.

Thus far the invention has been described in terms of it preferred embodiments of composition, but it will be understood that any change or variation made in the present invention based on the foregoing description will fall necessarily within the scope of the invention.

What I claim is:

1. In a pinata which comprises a hollow spherical body formed by two equal halves which are joined and which hollow body exhibits the exterior shape of a fanciful figure, the improvement characterized in that the two equal halves are affixed together along the flat surfaces of their respective edges to make up the hollow body having along its exterior surface opposite the joints of the two hollow halves, a lengthwise groove in which hanging means are fitted, the upper portion of the hollow body having a hollow neck to facilitate holding the pinata by said hanging means.

2. Improvements in accordance with claim 1, wherein the sphere has adornments on its outer surface.

3. Improvements in accordance with claim 2, wherein the adornments are strips and cuttings of a flexible laminar material.

4. Improvements in accordance with claim 1, wherein the hollow spherical body which forms the pinata is made of expanded polystyrene.

* * * * *